United States Patent [19]

Fisher

[11] 4,390,306

[45] Jun. 28, 1983

[54] COMPOSITE ARCH STRUCTURE

[75] Inventor: Christopher L. Fisher, Winnipeg, Canada

[73] Assignee: Armco Inc., Middletown, Ohio

[21] Appl. No.: 229,079

[22] Filed: Jan. 28, 1981

[51] Int. Cl.[3] ..... F16L 9/22; E01G 5/06; E21D 9/00

[52] U.S. Cl. ..... 405/124; 405/150; 52/89

[58] Field of Search ..... 405/124, 150, 151, 152, 405/138–141; 52/89, 86, 87, 334, 249

[56] References Cited

U.S. PATENT DOCUMENTS 3,161,553 12/1964 Visser ..... 52/89 X 3,508,406 4/1970 Fisher ..... 405/124

*Primary Examiner*—Dennis L. Taylor

*Attorney, Agent, or Firm*—Frost & Jacobs

[57] ABSTRACT

A composite arch structure and method of making it are taught. The composite arch structure comprises a pair of retaining wall portions and a top arch portion extending therebetween. A stiffening and load distributing member is structurally affixed to the top arch portion and extends longitudinally of the composite arch structure for the majority of the length of the structure. The composite arch structure preferably also includes longitudinally extending, load spreading buttress means on either side of the vertical axis of the structure at positions where a radial force acting on the structure forms an angle of about 45° or more to the horizontal.

20 Claims, 10 Drawing Figures

COMPOSITE ARCH STRUCTURE

TECHNICAL FIELD

The invention relates to new and useful improvements in composite arch structures of relatively large dimension, and more particularly to the provision of a stiffening and load distributing member, structurally connected to the top arch portion of the composite arch.

BACKGROUND ART

As used herein and in the claims, the term "composite arch structure" is intended to include arch structures having any one of a number of cross sectional configurations, well known in the art, such as circular, pipe arch, vertical elipse, horizontal elipse, underpass, arch, low profile arch, high profile arch and inverted pear.

In recent years, conventional rigid arch designs have been superseded by relatively flexible designs utilizing flexible retaining wall structures similar to those described in U.S. Pat. No. 3,282,056. The strength of these structures is derived primarily from the backfill material located thereabout. The structure, made up of curved, corrugated sheets, must have sufficient strength to be capable of self support during installation. The strength of the metallic structure, on the other hand, is not sufficient to support the superimposed load after installation. While its strength must be adequate to carry its share of the superimposed load after installation, the backfill material is intended to be the principle load bearing and transmitting element of the finished structure.

The design features of structures of this sort, utilizing the composite arch principle, are dependent upon the shear and compression values of the backfill material, the proper related curvatures of the flexible lining and the type of backfill material enveloping the underground structure when finished. So long as the dimensions of the composite arch structure remain relatively small, no difficulty is encountered in the backfilling procedure.

More recently, prior art workers have turned their attention to the construction of so called "long-span" composite arch structures, generally defined as having a span greater than from about 15 feet to about 25 feet (from about 4.6 m to about 7.6 m) and a minimum radius of curvature of from about 8 feet to about 12 feet (from about 2.4 m to about 3.7 m). Examples of such long-span composite arch structures are taught, for example, in U.S. Pat. Nos. 3,508,406 and 3,735,595.

Long-span structures are characterized by certain difficulties generally not encountered with the smaller structures. For one thing, they have less initial stability until supported by the backfill material and the backfilling procedure is far more critical. For example, as the backfill progresses upwardly along the flexible retaining wall portions of the composite arch structure, the top arch portion tends to shift upwardly at its center or "peak." To overcome this problem, the center part of the top arch portion may be loaded or held in place and in shape internally by frame members, cables or the like. Further difficulties are encountered when backfilling and compacting the soil along or around the junction lines between the flexible retaining walls (which have a relatively sharp curvature and are situated substantially vertically), and the flexible arch which extends therebetween. As the compaction proceeds, the horizontal component of the load becomes greater than the vertical component, thus causing distortion of the structure which can only be avoided by extremely careful backfilling from both sides.

Prior art workers have developed a number of expedients to overcome these difficulties. For example, the composite arch structure may be provided with open-top bins located along the upper surface of the liner. Backfill material is compacted in layers in the bins and around the liner, the bins serving to confine, reinforce and strengthen the compacted backfill, as well as acting as stiffeners for the top arch portion of the liner to reduce initial peaking and subsequent flattening. Such a structure is taught in the above mentioned U.S. Pat. No. 3,735,595.

Another expedient is to provide circumferential rib stiffeners about the liner. These rib stiffeners provide increased stiffness to reduce peaking during backfilling. They further reduce local buckling and excessive flattening during the remainder of the backfilling procedure.

Yet another expedient is set forth in the above mentioned U.S. Pat. No. 3,508,406 wherein longitudinally extending load spreading buttress means are provided on the composite arch structure, located to either side of the vertical axis thereof at positions where the radial force acting on the structure forms an angle of about 45° or more to the horizontal. These buttress means anchor the base of the top arch portion of the structure and provide lengths of consolidated material at the locations where compaction and backfilling equipment cannot effectively work, enabling the backfilling procedure to continue without distortion of the structure. For very wide arches, one or more stiffening members extending between the buttress means and over the top arch portion of the structure may be provided, the top arch portion of the structure being affixed to the stiffening members.

The American Association of State Highway and Transportation Officials (AASHTO) has devised a series of standard specifications for highway bridges, including long-span composite arch structures of the type to which the present invention is directed. To date, such structures have been built with spans up to 51 feet (16 m). It is presently generally accepted that the top arch portion of such structures is limited to from about a 60° to about an 80° central angle.

AASHTO Standards also set forth the minimum amount of cover or backfill to be located over the structure in order for the structure to perform properly. Where less than minimum overhead cover is applied, loads are not properly distributed through the soil and the soil or backfill does not sustain its preponderant share of the load. For example, under live load such as that imposed by a vehicle, failure can occur because this load is localized and applied to the area of the arch immediately below the point of load application. In situations where only minimum or less than minimum backfill can be applied to the top arch portion of the liner structure, prior art workers have provided an elongated slab of reinforced concrete located above the liner structure and near or immediately below the surface of the road extending across the shallow backfill cover. The elongated slab extends substantially the length of the liner structure and serves as a load spreading device.

The present invention is based upon the discovery that if, in a long span composite arch structure, a longitudinally extending stiffening element is structurally connected to the center of the top arch structure, extending substantially, the length of the structure, a number of advantages are obtained. First of all, the stiffening element, being structurally connected to the center of the top arch portion of the liner structure, serves as an arch "interrupter." In other words, that portion of the arch to which the stiffening element is connected is, itself, stiffened. The remainder of the arch structure remains flexible, capable of yielding to develop adequate soil arching. Nevertheless, the central angle of the structure has been subdivided into two lesser angles, as has the cord of the top arch portion. As a result, the top arch portion has been additionally rigidified. The top arch portion rigidity is approximately an inverse function of the square of the cord length or the angles subtended by the top arch portion and the segments into which it is divided. As a result of this, through the practice of the present invention the central angle of long span structures can safely be increased up to 90° or more and the span width may be increases up to about 60 feet.

Furthermore, the stiffening element can serve as top weighting for the structure, minimizing or preventing peaking during the backfilling operation. The stiffening element will serve as a live, thermal and dead load distributor, providing a sound structure even in circumstances where less than minimum recommended backfill cover must be used.

DISCLOSURE OF THE INVENTION

According to the invention there is provided a composite arch structure and a method of making it. The composite arch structure comprises a pair of retaining wall portions and a top arch portion extending therebetween. A stiffening and load distributing member is structurally connected to the top arch portion by shear connectors and extends longitudinally of the composite arch structure for the majority of its length.

In one embodiment, the stiffening and load distributing member comprises a reinforced concrete slab cast along the centermost part of the top arch portion, on the upper side thereof.

In another embodiment a longitudinally extending pair of structural members such as angles are affixed to the top arch portion in parallel spaced relationship, substantially quidistant from the centerline of the top arch portion.

DETAILED DESCRIPTION OF THE INVENTION

Figure 1:
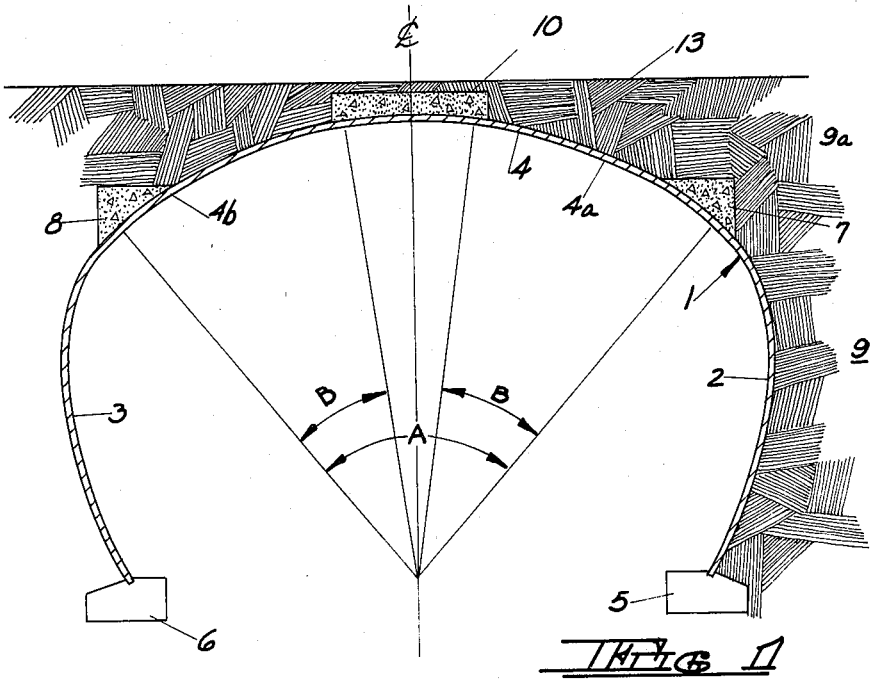
FIG. 1 is a transverse, cross sectional, elevational view of a composite arch structure of the present invention shown in situ.
Figure 2:
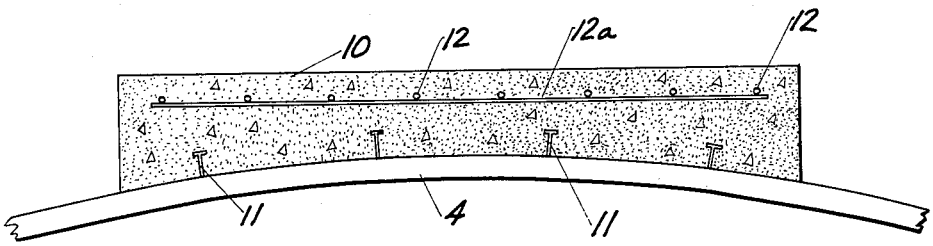
FIG. 2 is a fragmentary, enlarged, cross sectional view, illustrating the central part of the top arch portion of the structure of FIG. 1 with the stiffening and load distributing member structurally connected thereto.
Figure 3:
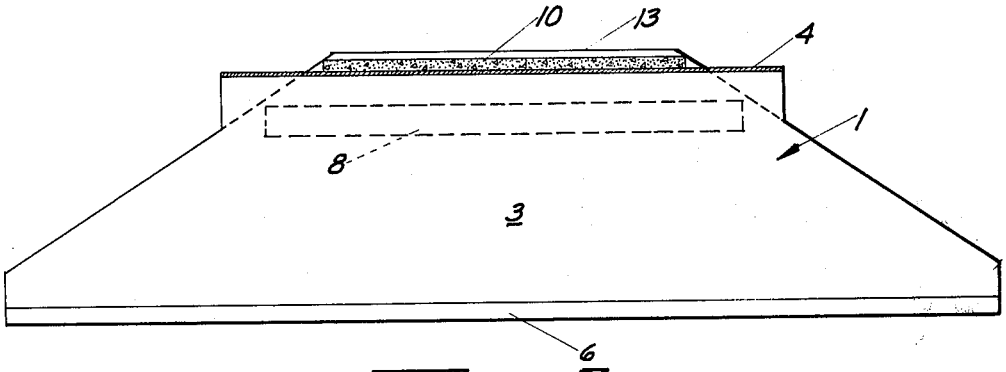
FIG. 3 is a longitudinal, cross sectional, elevational view of the composite arch structure of FIG. 1.

Reference is made to FIGS. 1, 2 and 3 wherein like parts have been given like index numerals. As is most clearly seen in FIG. 1, the composite arch structure comprises a liner (generally indicated at 1), having a pair of flexible retaining wall portion 2 and 3 and a top arch portion 4 extending therebetween. The liner is made of relatively thin gauge corrugated metallic plates having their edges lapped and bolted together. While the Figures do not illustrate the individual plates of the liner, this construction is conventional and well known in the art. For purposes of an exemplary showing, the liner 1 is illustrated as being of the high profile arch type. It will be understood by one skilled in the art that the invention is applicable to liners of any of the well known cross sectional configurations mentioned above.

The lowermost edges of the flexible retaining wall portions 2 and 3 may be supported by footers 5 and 6 which may be of the type described in U.S. Pat. No. 3,508,406 or U.S. Pat. No. 4,010,617. The precise nature of footers 5 and 6 can vary and does not constitute a limitation of the present invention. Some composite arch structures do not need footers.

While not required, it is preferred that the liner 1 be provided with longitudinally extending buttress means 7 and 8, of the type described in the above mentioned U.S. Pat. No. 3,508,406. The buttress means 7 and 8 are generally reinforced concrete members shear connected to the liner 1 and normally cast in place once the compacted backfill material 9 has reached a height on each side of the structure just below the position of buttress means 7 and 8.

Buttress means 7 and 8 generally extend the majority of the length of liner 1 (see FIG. 3) and are located along the juncture of the flexible retaining wall portions 2 and 3 and the flexible top arch portion 4. Stated another way, the buttress means 7 and 8 are located on either side of the liner 1 at positions where a radial force acting on the structure forms an angle of about 45° or more to the horizontal.

Buttress means 7 and 8 serve a number of important purposes. First of all, they tend to anchor the base parts of top arch portion 4 and the upper parts of retaining wall portions 2 and 3. The buttress means provide support and a vertical wall against which the backfill material can be compacted, spreading the load over a greater area at this vital point of the backfilling and compacting procedures. Since the top arch portion 4 is flexible, care must be taken during this portion of the backfilling and compacting procedure up to and including buttress means 7 and 8 to prevent the top arch portion from shifting upwardly at its center or "peaking." On the other hand, when the top cover portion of the backfill is located in place and compacted, the top arch portion 4 will tend to move downward. At the present time, it is generally accepted that the angle A subtended by the top arch section 4 should not exceed about 80°. With structures of relatively large span, the above mentioned U.S. Pat. No. 3,508,406 recommends the provision of arcuate curved reinforcing and stabilizing members over-spanning the top arch portion 4 and affixed at their ends to buttress means 7 and 8. These stiffening members are curved to follow the curvature of the top arch portion 4 and are affixed thereto.

Another consideration in the construction of long-span structures of the type contemplated by this invention has to do with the amount of cover or backfill placed and compacted over the top of the top arch portion 4. The cover should be sufficient to enable the backfill to accept its proponderant portion of the load to which the composite arch structure will be subjected. Otherwise, the liner 1 will be subjected to a disproportionate amount of load which might lead to deformation or failure. AASHTO specifications set forth minimum cover standards for structures of various sizes utilizing liners of various gauges.

The present invention is based upon the discovery that a stiffening and load distributing member, when structurally connected to the top arch portion 4 of the liner by shear connectors or other appropriate means, will rigidify the top arch portion 4 so that it will maintain its proper configuration during the backfilling and compacting procedures, enabling structures of greater span to be produced, and in shallow cover situations reducing the minimum amount of cover required. The top stiffening and load distributing element can be of any appropriate material, made in any appropriate manner so long as it possesses certain structural performance characteristics such as adequate compression characteristics (thrust resistance), adequate shear resistance (resistance to transverse movement with respect to the liner 1) and moment characteristics (adequate stiffness or bending strength). All of these characteristics should be present under live, thermal and dead load conditions. The top stiffening and load distributing member could, for example, itself be fabricated of metal or the like. For purposes of an exemplary illustration, the top stiffening and load distributing member will be described as an elongated, reinforced, concrete slab or beam. Such a concrete slab or beam has a number of advantages in that it is easy inexpensive to manufacture and has sufficient weight or mass to serve as a top loading element to minimize peaking during the early stages of the backfilling and compacting procedure. Such a concrete stiffening and load distributing member is shown in FIGS. 1 through 3 at 10. As will be evident from FIG. 3, the slab 10 extends substantially the length of liner 1, along the center of the top arch portion (see also FIG. 1).

It is important that the slab 10 be affixed to the top arch portion 4 by shear connectors or other appropriate means. When shear connectors are used they may be of any well known type. For example, they may constitute bolts affixed to the top arch portion 4 and extending thereabove, or they may be elements welded to the upper surface of the top arch portion 4. Such welded shear connectors are illustrated in FIG. 2 at 11.

FIG. 2 also illustrates reinforcing members or bars located within the slab 10. The bars 12 extend longitudinally of the slab and additional bars extend transversely of the slab, one of which is shown at 12*a*.

That part of top arch portion 4 immediately beneath slab 10 is now rigid and no longer flexible because of the connection of slab 10 to that part of top arch portion 4. The original flexible arch subtending angle A has now been divided into two shorter equal flexible top arch portions 4*a* and 4*b*, each subtending a small angle B. Thus, slab 10 serves as an "interrupter," dividing the single flexible top arch portion 4 into two smaller flexible top arch portions 4*a* and 4*b*. The rigidity of top arch portion 4 is approximately an inverse function of the square of the angle subtended thereby. Thus, the rigidity (R) of top arch portion 4 may be set forth as follows:

$$R=(A/B)^2$$

Thus, if angle A is 80° and each of the angles B is about 30°, the top arch portion 4 is now about 7 times more rigid by virtue of the presence of slab 10. As a result of this, the central angle A of structures of this sort can, in the practice of the present invention, be increased safely up to about 90° or more. In addition, long span structures can be made safely having a span width up to about 60 feet.

For purposes of an exemplary showing, the composite arch structure of FIGS. 1 through 3 is illustrated in a shallow cover configuration surmounted by a roadway surface 13.

A true soil arch is not formed until the amount of cover backfill reaches the point that, adding more will not increase the load on the liner 1. As indicated above, AASHTO standards have been set for minimum cover for various sizes of structure and gauge of metal used in the liner. Below these limits, the live, thermal and dead loads could exceed the design capability of the liner, resulting in failure of the structure. In situations having less than minimum overhead cover, these loads are not distributed over the entire structure and failure can occur because some of these loads can become localized and applied directly to the liner 1. For example, in the embodiment illustrated in FIGS. 1 through 3, the live load of a vehicle passing over the structure could be localized and applied to the area of the liner immediately below the point of application. However, with the slab 10 mounted on the liner, such a load is distributed substantially over the entire liner with the result that minimum or less than minimum cover can be safely used.

In the embodiment of FIGS. 1 through 3, the slab can be poured immediately after assembly of liner 1. Preferably, however, the slab 10 or 10*a* is poured at about the same time the buttress means 7 and 8 are poured, if buttress means are used. The slab 10, for example, can be poured using a crane with a concrete bucket or concrete trucks with chutes. It would not be necessary to drive a concrete truck onto the crown or top arch portion 4 of liner 1.

Figure 4:
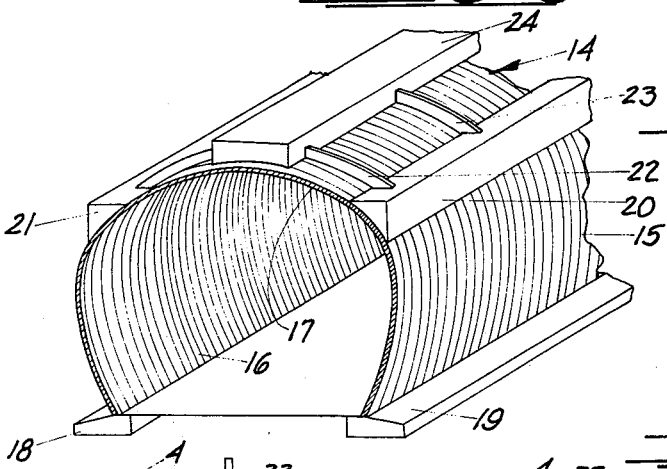
FIG. 4 is a fragmentary perspective view of the composite arch structure of FIG. 1 provided with transverse stiffening members extending between the buttress means and through the stiffening and load distributing member of the present invention.

FIG. 4 is a perspective view of a composite arch structure similar to that of FIG. 1 but having a span in excess of about 50 feet. The liner is generally indicated at 14, and comprises a pair of flexible retaining wall portions 15 and 16 and a top arch portion 17. As in the case of the structure of FIG. 1, the composite arch structure of FIG. 4 is provided with footers 18 and 19 and buttress means 20 and 21.

In structures having a maximum span greater than about 50 feet it has often been found advantageous to provide a plurality of transverse stiffening members of the type taught in the above mentioned U.S. Pat. No. 3,508,406. Two such stiffening members are shown in FIG. 4 at 22 and 23. The stiffening members conform to the shape of the top arch portion 4 and overspan the top arch portion in parallel spaced relationship. The ends of stiffening members 22 and 23 are appropriately affixed to buttress means 20 and 21. If desired, the top arch portion 17 can be connected to the stiffening members 22 and 23 by bolts or other appropriate fastening means.

The embodiment of FIG. 4 is also provided with the stiffening and load distributing member of the present invention, indicated at 24. For purposes of an exemplary showing, the stiffening and load distributing member 24 is illustrated as being a reinforced concrete slab poured in place and directly over stiffening members 22 and 23 which extend therethrough. In this way, the stiffening members serve as additional reinforcement for the slab 24 as well as reinforcing and stabilizing means for the top arch portion, preventing sagging of the top arch portion due to the static load inherent in the construction of such long-span structures.

Figure 5:
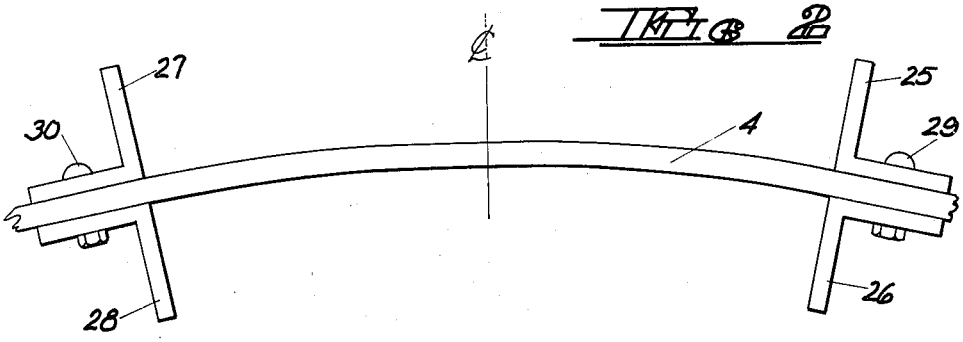
FIG. 5 is a fragmentary cross sectional view illustrating an alternate form of the stiffening and load distributing member of the present invention.

As indicated above, the stiffening and load distributing member of the present invention need not take the form of a reinforced concrete slab. FIG. 5 is a fragmentary cross sectional view of top arch portion 4, similar to FIG. 2. In this instance, the slab 10 has been replaced by pairs of longitudinally extending angles 25–26 and 27–28. Angles 25–26 are located directly opposite each other on the top and bottom surfaces of the top arch portion 4, as shown. The same is true of angles 27–28. The angle pairs 25–26 and 27–28 are located in parallel spaced relationship and are substantially equally spaced to either side of the centerline of the top arch portion 4. The angle pairs may be attached to the top arch portion 4 by a plurality of bolts (two of which are shown at 29 and 30), or by any other appropriate fastening means. The angle pairs 25–26 and 27–28 serve to align the corrugations of the adjacent liner plates and, together with that part of top arch portion 4 extending between the angle pairs, form an "I-beam" which serves substantially the same purposes as does slab 10 of FIG. 2. It would also be within the scope of the invention to provide angles 25 and 27 only or angles 26 and 28 only, depending upon the span of the liner. For longer span structures the provision of pairs of angles 25–26 and 27–28 is preferred.

Figure 6:
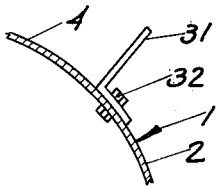
FIGS. 6 through 10 are fragmentary cross sectional views illustrating alternate forms of stiffeners to be used in place of the buttress means of FIGS. 1 through 3.

FIGS. 6 through 10 illustrate various types of longitudinal extending load spreading means which may be substituted for buttresses 7 and 8 in FIGS. 1 and 3. In FIG. 6 liner 1 is shown fragmentarily, made up of retaining wall portion 2 and top arch portion 4. In this Figure buttress means 7 has been replaced by a longitudinally extending angle 31. The lower leg of angle 31 is affixed to liner 1 by any appropriate means such as bolts, one of which is shown at 32. That leg of angle 31 abutting liner 1 may be slightly curved to conform to the liner, if desired.

Figure 7:
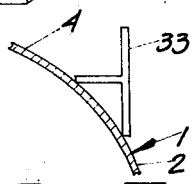

In FIG. 7 like parts have been given like index numerals and buttress means 7 has been replaced by a longitudinally extending T-beam 33 affixed to liner 1 by bolts or other appropriate means (not shown).

Figure 8:
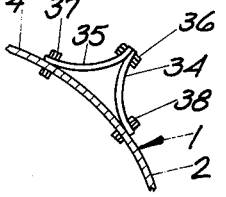

In FIG. 8 (as in FIGS. 9 and 10 to be described hereinafter) like parts have again been given like index numerals. In this instance buttress means 7 has been replaced by a plurality of longitudinally extending, transversely curved corrugated metal plates (two of which are shown at 34 and 35) joined together by bolts (one of which is shown at 36) and joined to the liner 1 by additional bolts (two of which are shown at 37 and 38). The structure of FIG. 8 may be filled with concrete or other consolidated material, if desired.

Figure 9:
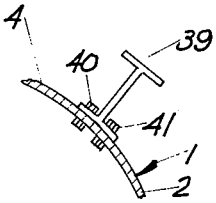

FIG. 9 illustrates an H-beam 39 as a replacement for buttress means 7. The H-beam 39 is affixed to liner 1 by a plurality of bolts (two of which are shown at 40 and 41) or other fastening means.

Figure 10:
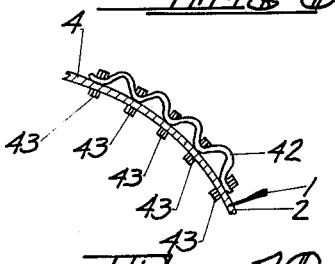

In FIG. 10, buttress means 7 has been replaced by one or more longitudinally extending corrugated metallic plates 42 connected to liner 1 by bolts 43 (or other appropriate fastening means) located along the longitudinal edges and valleys of the plate 42.

EXAMPLE

A composite arch structure of the type shown in FIGS. 1 through 3 was constructed. The liner was made of 1 gauge corrugated steel plates having a high arch profile, a maximum span of 33 feet 1 inch and a height above the footers of 21 feet 6 inches. Buttresses of the type shown at 7 and 8 were provided, and the stiffening and load distributing member 10 constituted a reinforced concrete member poured at substantially the same time as the buttress means 7 and 8 were poured. The concrete slab 10 was shear connected to the top arch portion of the structure by welded shear connectors spaced on 24 inch centers along both the width and length of the concrete slab. The concrete slab was 8 feet wide and 12 inches thick at the topmost portion of the top arch section. The slab extended substantially the entire length of the topmost part of the top arch portion, i.e., 32 feet. The bottom center line length of the liner was 92 feet and the top center line length thereof was 52 feet.

The AASHTO standard specifications call for a minimum cover for this type of structure of 3 feet. In the particular installation, as a roadway bridge over a railroad, a three foot cover would require too steep a grade for vehicles crossing the bridge. By virtue of the stiffening and load distributing concrete slab, a cover of from between 15 and 18 inches was placed over the structure.

During construction, the structure maintained its shape well and in service tests after completion have shown that the structure has maintained its shape and demonstrated adequate strength for the loads to which it is subjected.

Modifications may be made in the invention without departing from the spirit of it.

What is claimed is:

1. In a composite arch structure of the type comprising an elongated, relatively thin gauge liner with compacted backfill thereabout, said liner comprising first and second flexible retaining wall portions and a flexible top arch portion extending therebetween, said first and second retaining walls having longitudinally extending upper edges, said top arch portion having longitudinally extending lateral edges affixed respectively to said upper edges of said first and second retaining wall portions, the improvement comprising a stiffening and load distributing member structurally connected to said top arch portion and extending centrally and longitudinally of said top arch portion for the majority at least of the length thereof.

2. The structure claimed in claim 1 wherein said stiffening and load distributing member comprises a reinforced concrete slab affixed to the upper surface of said top arch portion.

3. The structure claimed in claim 1 including first and second pairs of angles, said angles of said pairs extending longitudinally of and substantially the length of said top arch portion, said angles of said first pair being located respectively above and below said top arch portion directly opposite each other, said angles of said second pair being located respectively above and below said top arch portion directly opposite each other, said first and second pairs of angles being affixed to said top arch portion in parallel spaced relationship to either side of the centerline of said top arch portion, and substantially equidistant from said centerline, said first and second pairs of angles and that part of said top arch portion extending between said first and second angle pairs comprising said stiffening and load distributing member.

4. The structure claimed in claim 1 including first and second angles extending longitudinally of and substantially the length of said top arch portion, said first and second angles being affixed to the upper surface of said top arch portion in parallel spaced relationship to either side of the centerline of said top arch portion and substantially equidistant from said centerline, said first and second angles and that part of said top arch portion extending therebetween comprising said stiffening and load distributing member.

5. The structure claimed in claim 1 including first and second angles extending longitudinally of and substantially the length of said top arch portion, said first and second angles being affixed to the lower surface of said top arch portion in parallel spaced relationship to either side of the centerline of said top arch portion and substantially equidistant from said centerline, said first and second angles and that part of said top arch portion extending therebetween comprising said stiffening and load distributing member.

6. The structure claimed in claim 1 including a pair of load spreading mean comprising elongated bodies extending longitudinally of said liner, said load spreading means being affixed to the exterior of said liner on either side of the vertical axis thereof at positions where a radial force acting on said liner forms an angle of about 45° or more to the horizontal.

7. The structure claimed in claim 6 wherein each of said load spreading means comprises an elongated concrete body.

8. The structure claimed in claim 6 wherein each of said load spreading means comprises an elongated angle member.

9. The structure claimed in claim 6 wherein each of said load spreading means comprises an elongated T-beam.

10. The structure claimed in claim 6 wherein each of said load spreading means comprises an elongated H-beam.

11. The structure claimed in claim 6 wherein each of said load spreading means comprises at least one pair of elongated, transversely curved, corrugated metallic plates joined together at one of their longitudinal edges and affixed to said liner at the other of their longitudinal edges, forming an inverted V-shaped member affixed to said liner.

12. The structure claimed in claim 6 wherein each of said load spreading means comprises at least one elongated transversely corrugated metallic plate affixed to said liner.

13. The structure claimed in claim 6 including a plurality of arcuate stiffening members, each of said stiffening members having its ends affixed to said pair of load spreading means and overspanning said top arch portion, said top arch portion being affixed to said arcuate stiffening members.

14. The structure claimed in claim 13 wherein said stiffening and load distributing member comprises a reinforced concrete slab cast in situ, said arcuate stiffening members passing therethrough.

15. A method of constructing a composite arch structure of the type comprising an elongated relatively thin gauge liner with compacted backfill thereabout, said liner comprising a pair of flexible retaining wall portions connected at their upper longitudinal edges to a top arch portion extending therebetween, comprising the steps of assembling said liner in situ, backfilling and compacting backfill material against the exterior surface of both sides of said liner to positions thereon where a radial force on said liner forms an angle of about 45° or more to the horizontal, structurally connecting to said top arch portion of said liner an elongated stiffening and load distributing member, locating said stiffening and load distrubiting member longitudinally and centrally of said top arch portion, and continuing backfilling and compacting backfill material to cover said liner and said stiffening and load distributing member.

16. The method claimed in claim 15 wherein said stiffening and load distributing member comprises a reinforced concrete slab.

17. The method claimed in claim 16 including the step of casting said slab in situ.

18. The method claimed in claim 16 including the step of pre-casting said slab.

19. A method of constructing a composite arch structure of the type comprising an elongated relatively thin gauge liner with compacted backfill thereabout, said liner comprising a pair of flexible retaining wall portions connected at their upper longitudinal edges to a top arch portion extending therebetween, comprising the steps of assembling said liner in situ, structurally connecting to said top arch portion of said liner an elongated stiffening and load distributing member longitudinally and centrally of said top arch structure and backfilling and compacting backfill material about said liner and said stiffening and load distributing member.

20. The method claimed in claim 19 wherein said stiffening and load distributing member comprises a reinforced concrete slab.

* * * * *